US006417628B1

(12) United States Patent
Li et al.

(10) Patent No.: US 6,417,628 B1
(45) Date of Patent: Jul. 9, 2002

(54) PROTECTIVE DEVICE FOR A TUBE ON A PLASMA DISPLAY PANEL

(75) Inventors: Chien-Hsing Li, Tai-Chung; Jiun-Han Wu, Sanchung; Po-Cheng Chen, Yung-Ho, all of (TW)

(73) Assignee: AU Optronics Corp., Hsinchu (TW)

( * ) Notice: Subject to any disclaimer, the term of this patent is extended or adjusted under 35 U.S.C. 154(b) by 0 days.

(21) Appl. No.: 09/682,551

(22) Filed: Sep. 19, 2001

(30) Foreign Application Priority Data

Oct. 20, 2000 (TW) ..... 089122056

(51) Int. Cl.[7] ..... G09G 3/10
(52) U.S. Cl. ..... 315/169.4; 313/238
(58) Field of Search ..... 315/169.4, 169.1; 313/146, 563, 238, 239

(56) References Cited

U.S. PATENT DOCUMENTS 4,317,061 A * 2/1982 Mendelsohn ..... 313/174
4,730,139 A * 3/1988 Harvey ..... 313/15

* cited by examiner

*Primary Examiner*—Don Wong
*Assistant Examiner*—Thuy Vinh Tran
(74) *Attorney, Agent, or Firm*—Winston Hsu

(57) ABSTRACT

A protective device for a tube bonded on a plasma display panel (PDP). The PDP includes a plate which does not break when experiencing a first force, an air holo for passing air above and below the plate and in air communications with the tube, and doughnut-shaped base disposed around the air hole and the tube. The protective device includes a hollow shield with a first opening on a bottom end bonded to the doughnut-shaped base for containing the tube, and a binding compound for binding the hollow shield to the doughnut-shaped base. The hollow shield remains bonded to the doughnut-shaped base when experiencing a second force which is smaller than the first force. When the hollow shield experiences an external force greater than the second force, the hollow shield will separate from the doughnut shaped base without breaking the plate.

10 Claims, 4 Drawing Sheets

PROTECTIVE DEVICE FOR A TUBE ON A PLASMA DISPLAY PANEL

BACKGROUND OF THE INVENTION

1. Field of the Invention

The present invention relates to a protective device, more specifically, to a protective device for a tube on a plasma display panel.

2. Description of the Prior Art

A plasma display panel (PDP) generates its images through discharge of gas. Within the PDP is a space, micrometers in size, coated with fluorescent cells and filled with discharge gas. When a voltage is applied to the discharge gas, a discharge occurs within the gas to generate ultraviolet (UV) radiation. The UV radiation causes each fluorescent cell to emit one of the primary colors, red, green or blue. Hence, with the proper combination of cells and their associated colors, a bright and vivid image is displayed.

Please refer to FIG. 1 of a perspective view of a tube 18 of a PDP 10 according to the prior art. The plasma display panel 10 comprises a front plate 12 and a rear plate 14. In the prior art manufacturing method for a PDP 10, the front panel 12 and the rear panel 14 are first produced respectively and then sealed together. Then, air is extracted from the space between the two panels and then the space is filled with a mixture of dischargeable gas such asNeon and Xenon. The sealed PDP 10 is then assembled with other components and is packaged within a housing to form an end product.

According to the prior art, an air hole is positioned at a corner edge of the rear panel 14, surrounded by a doughnut-shaped base 16. During the sealing process, a tube 18 is fixed to the base 16 for extracting gas out of the space between the two panels 12, 14 and inputting gas mixture into the space. After inputting sufficient gas mixture, the tube 18 is cut to reduce its length and melted to seal the space between the front panel 12 and rear panel 14 of the plasma display panel 10 for the subsequent assembly process.

Due to protrusion of the tube 18 of the PDP 10, the PDP 10 may break easily during the process of delivery and storage, resulting in defects in the PDP 10. Once breakage of the tube 18 occurs, the Neon and Xenon gas mixture within the PDP 10 is released to allow entry of outside air particles, thereby polluting the PDP 10. Even if the tube 18 is re-sealed, the performance of the PDP 10 still decreases due to the prior leakage of the gas mixture and entrance of outside air particles. Thus, a protective device is required to prevent breakage of the tube 18 of the PDP 10 caused by an impact of an external force.

SUMMARY OF INVENTION

It is therefore a primary object of the claimed invention to provide a protective device for a tube on a PDP to prevent tube breakage due to an impact of an external force, thereby maintaining the quality of the PDP.

According to the claimed invention, the protective device is used for a tube bonded on a plasma display panel (PDP). The PDP comprises a plate which does not break when experiencing a first force, anair hole for passing air above and below the plate and in air communications with the tube, and a doughnut-shaped base disposed around the air hole and the tube. The protective device comprises a hollow shield with a first opening on a bottom end bonded to the doughnut-shaped base for containing the tube, and a binding compound for binding the hollow shield to the doughnut-shaped base. The hollow shield remains bonded to the doughnut-shaped base when experiencing a second force which is smaller than the first force. When the hollow shield experiences an external force greater than the second force, the hollow shield will separate from the doughnut-shaped base without breaking the plate.

It is an advantage of the claimed invention that the use of the protective device can effectively protect the tube and the plate from being damaged by an external force.

These and other objectives of the present invention will no doubt become obvious to those of ordinary skill in the art after reading the following detailed description of the preferred embodiment, which is illustrated in the various figures and drawings.

DETAILED DESCRIPTION

Figure 1:
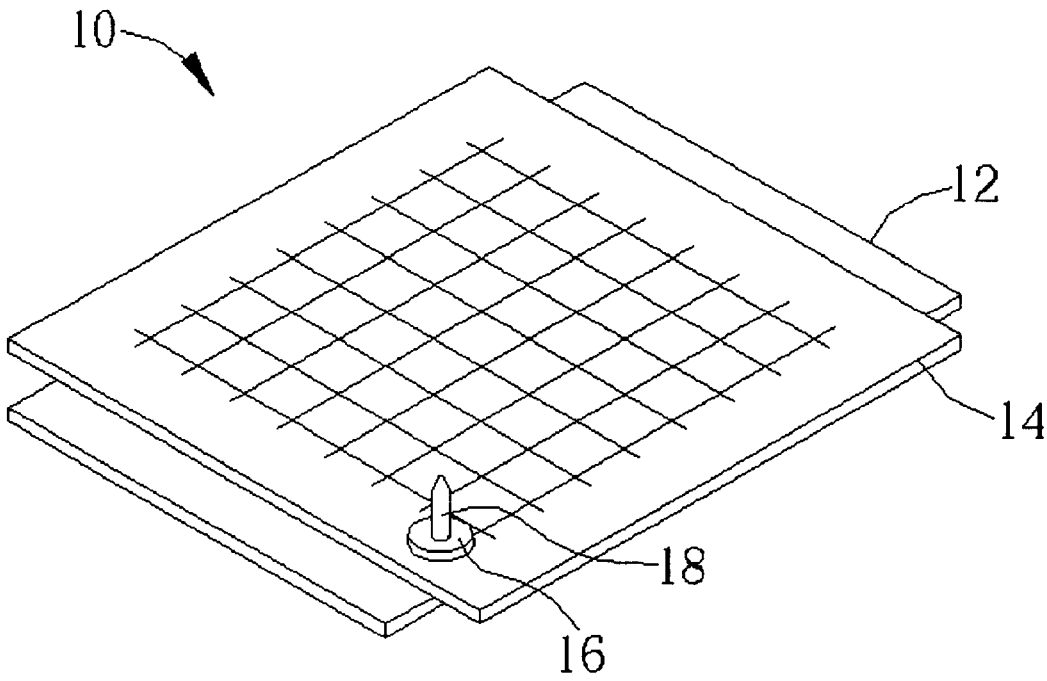
Fig. 1 Prior art
FIG.1 is a perspective view of a tube of a PDP according to the prior art.
Figure 2:
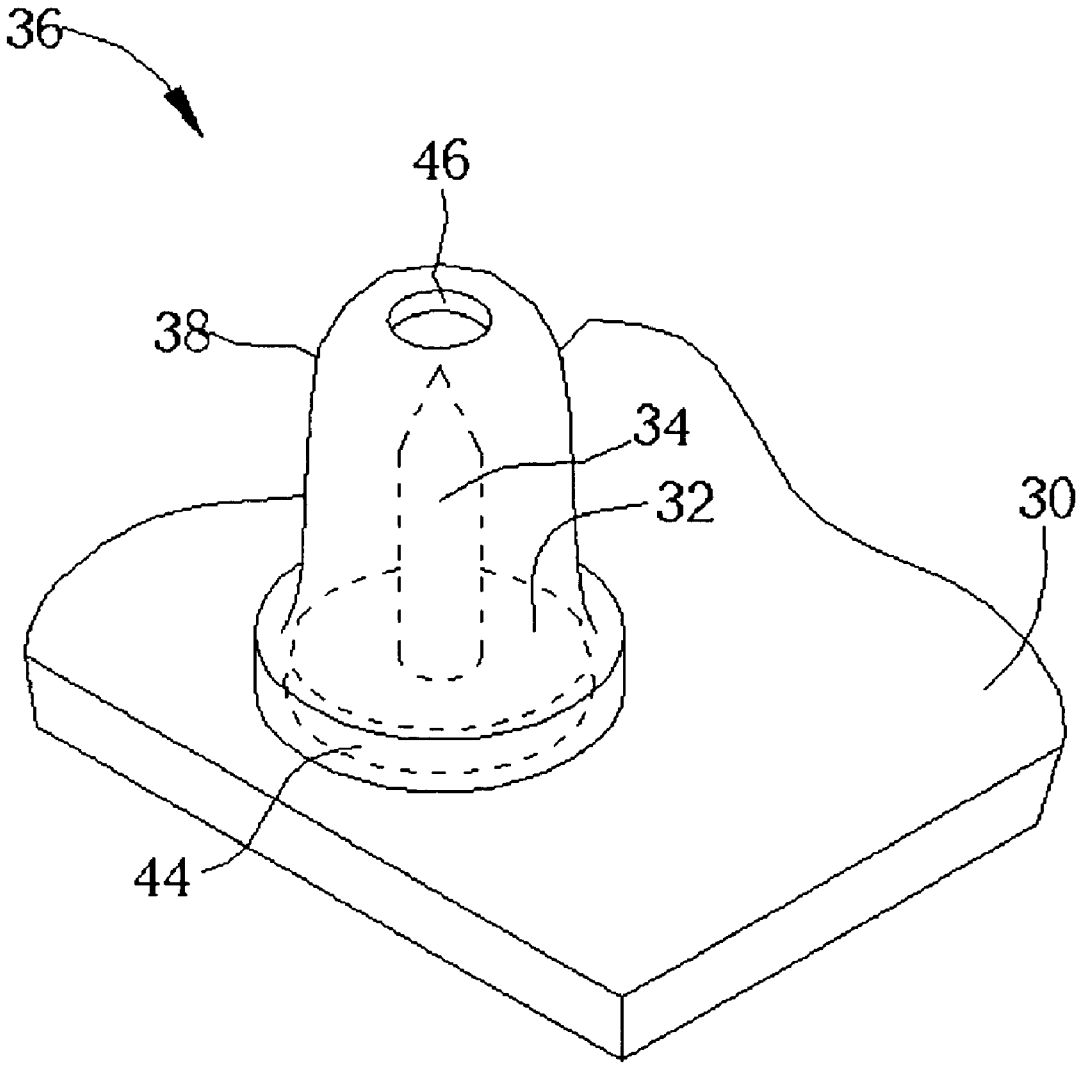
FIG.2 is a perspective view of a protective device for a tube on a PDP according to the present invention
Figure 3:
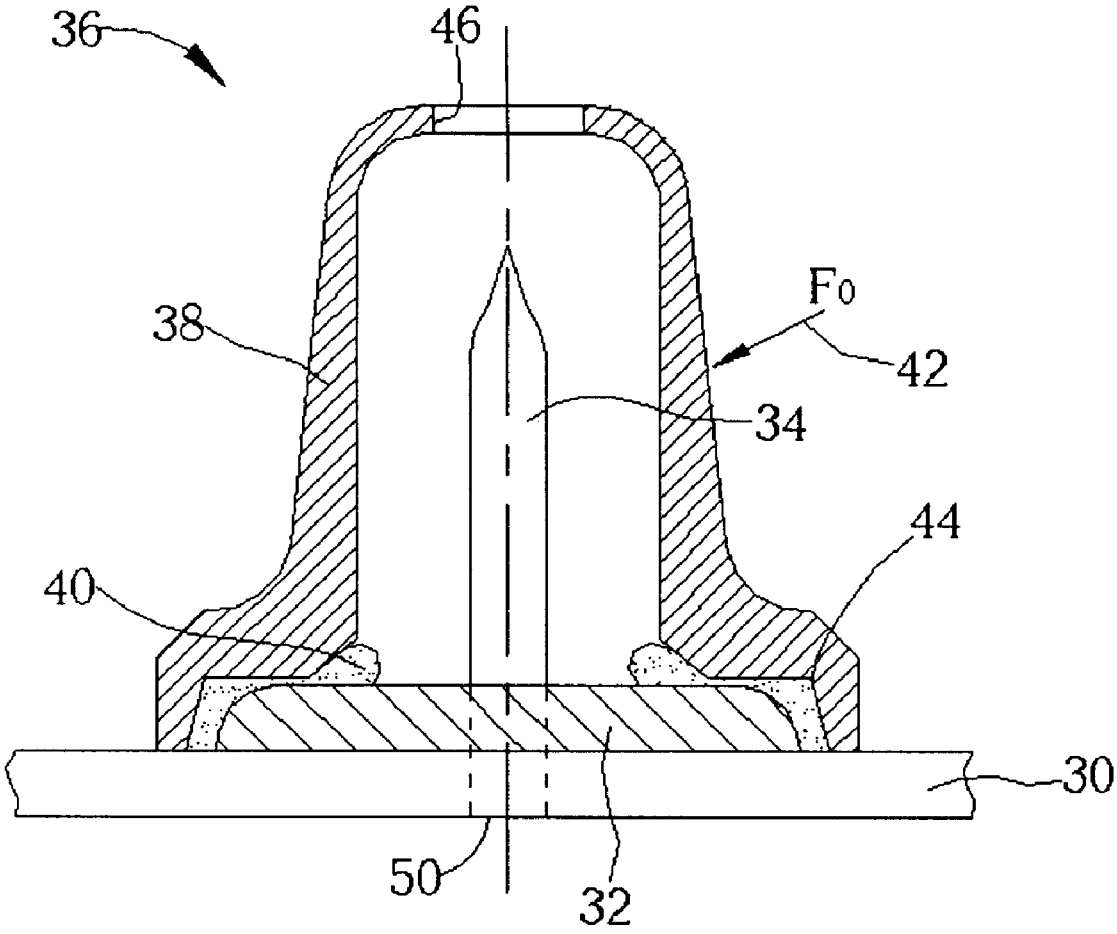
FIG.3 is a sectional view of the protective device shown in FIG.2.

Please refer to FIG.2 and FIG.3. FIG.2 is a perspective view of a protective device 36 for a tube 34 of a PDP 10 according to the present invention and FIG.3 is a sectional view of the protective device 36 shown in FIG.2. As shown in FIG.2 and FIG.3, the plasma display panel (PDP) comprises a plate 30, with an air hole 50 and a doughnut-shaped base 32 disposed around the air hole 50 and the tube 34. The tube 34 is in air communications with the air hole 50. The doughnut-shaped base 32 may be made of sealing frit or other similar sealing materials.

The protective device 36 on the doughnut-shaped base 32 includes a hollow shield 38 and a binding compound, such as silicone 40 for fixing the hollow shield 38 onto the doughnut-shaped base 32. The hollow shield 38 is used to protect the tube 34 from breaking by an external force 42. In addition, the solidified silicone 40 acts as a cushion for the protective device 36 on the plate 30 against the external force 42.

To a certain magnitude, the external force 42 imposed on the hollow shield 38 is elastically neutralized by the silicone 40. However, if the external force 42 exceeds a certain magnitude, the hollow shield 38 will disconnect from the silicone 40 on the doughnut-shaped base 32 or from the doughnut-shaped base 32 to avoid breakage of the tube 34, or even the plate 30. After disconnection, the hollow shield 38 can be bonded to the plate 30 again by the silicone 40 to protect the tube 34. Even if the hollow shield 38 causes breakage of the tube 34 from the plate 30 during the disconnection of the hollow shield 38 from the silicone 40 or from the doughnut-shaped base 32, the plate 30 remains intact. And after re-sealing the tube 34, the plate 30 can be reused. In addition, a second opening 46 is positioned on a top end of the hollow shield 38 to assist in the solidification of the silicone 40, and to inspect the breakage of the tube 34.

More specifically, the binding compound connects the hollow shield 38 with the doughnut-shaped base 32 and resists against an external force of a magnitude smaller than that of a force leading to a disconnection of the hollow shield 38 from the doughnut-shaped base 32. Further, a large external force disconnects the hollow shield 38 from the doughnut-shaped base 32 so as to prevent breakage of the tube 34 or plate 30. In the case of tube breakage, the doughnut-shaped base 32 and the plate 30 remain intact.

The concavity of the arc-shaped outer wall of the hollow shield 38 functions to decrease the impact of the external force 42 on the protective device 36. In addition, a first opening 44 is located inside a bottom end of the hollow shield 38 and surrounds the doughnut-shaped base 32, to strengthen the resistance of the protective device 36 against the external force 42 as well as prevent slanting of the protective device 36 when bonded to the doughnut-shaped base 32.

The hollow shield 38 is commonly made of hardened plastic materials. The inner wall of the hollow shield 38 is at a safe distance away from the tube 34, roughly 2 to 3.5 cm. To prevent compression of the tube 34 by the hollow shield 38 under the external force 42, the preferable safety distance is between 2.48 to 2.98 cm. Similar to the silicone 40, hardened plastic materials are relatively inexpensive, simple to process and easily available on the market. These factors make the protective device 36 both efficient and cost-effective. Also, the hollow shield 38 may be made of a transparent material for easy inspection, with added coloration for easy detection.

Figure 4:
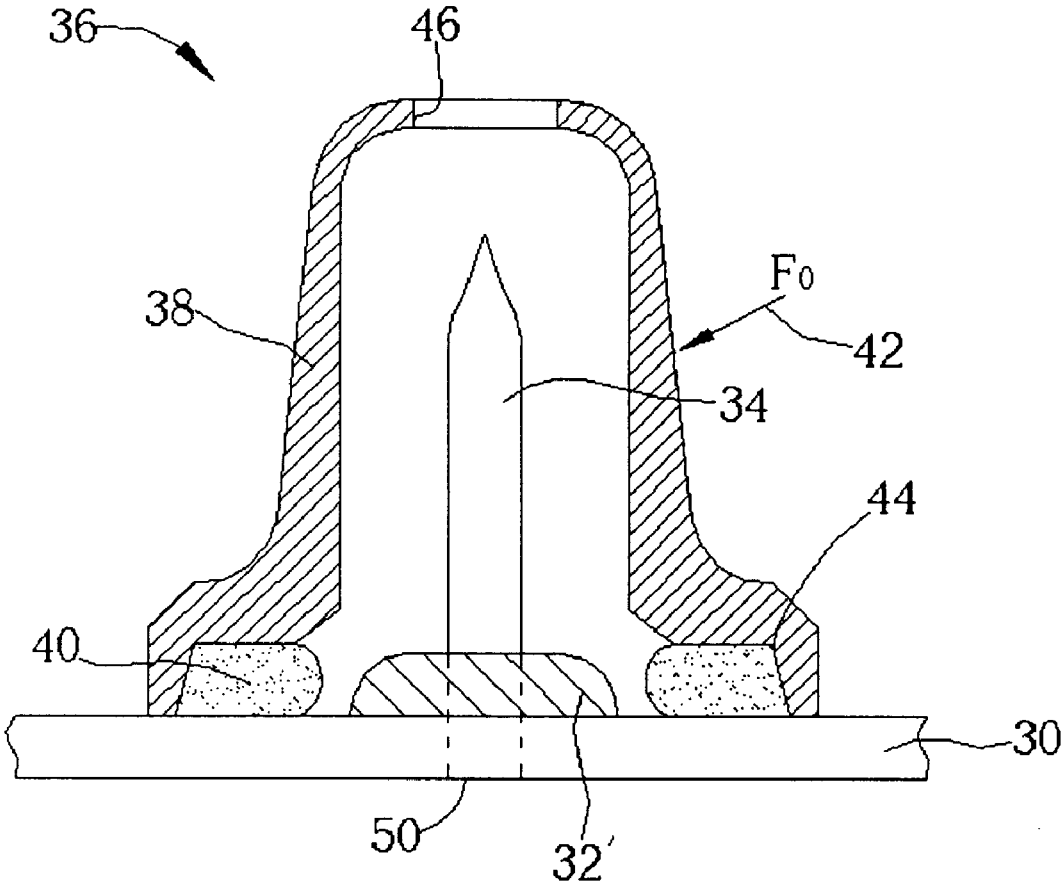
FIG.4 is a perspective view of an alternative protective device for the tube on the PDP in FIG.2.

Please refer to FIG.4 of a perspective view of an alternative protective device 36 for the tube 34 on the PDP 10 according to the present invention. As shown in FIG.4, the protective device 36 comprises a hollow shield 38 directly connected to a plate 30 by using silicone 40. A second opening 46 on a top end of the hollow shield 38 is used to assist in the solidification of the silicone 40. Also, with a first opening 46 on a bottom end of the hollow shield 38, the hollow shield 38 connects with the plate 30 using the silicone 40.

Correspondingly, the plate 30 comprises an air hole 50 (shown by the dotted lines). The PDP 10 further comprises a doughnut-shaped base 32 disposed on the plate 30 around the air hole 50 and the tube 34. The tube 34 is in air communications with the air hole. The doughnut-shaped base 32 may be made of sealing frit or other similar sealing materials. Using the silicone 40, the hollow shield 38 can directly connect with the plate 30, rather than with the doughnut-shaped base 32, via various fusing methods and various sizes of the doughnut-shaped base 32. When the hollow shield 38 encounters an external force 42, the silicone 40 elastically neutralizes the effect to protect the tube 34 and the doughnut-shaped base 32.

According to the present invention, the protective device 36 for the tube 34 on the plasma display panel 10 protects the tube 34 from the impact of the external force 42. Also, the arc-shaped and concaved outer wall of the hollow shield 38 reduces the impact of the external force 42. With the first opening 44 on the bottom end of the hollow shield 38 and the safety distance between the tube 34 and the hollow shield 38, the resistance of the protective device 36 against the external force 42 can be significantly increased with the use of the silicone 40 as a cushion. When the magnitude of the external force 42 exceeds the tolerance of the hollow shield 38, the silicone 40 enables the hollow shield 38 to disconnect from the plate 30 without damaging the plate 30.

More specifically, the binding compound 40 connects the hollow shield 38 to the plate 30 to make them resistant to an external force of a certain magnitude smaller than that of a force leading to a disconnection of the hollow shield 38 from the plate 30, so as to keep the plate 30 intact. When encountering a large external force, the hollow shield 38 is disconnected from the plate 30 to prevent breakage of the plate 30.

In comparison with the prior art, the protective device 36 of the tube 24 of the PDP 10 reduces the impact of external forces to prevent damage to the tube 24 and the plate 30.

Those skilled in the art will readily observe that numerous modifications and alterations of the device may be made while retaining the teachings of the invention. Accordingly, the above disclosure should be construed as limited only by the metes and bound of the appended claims.

What is claimed is:

1. A protective device for a tube bonded on a plasma display panel (PDP), the PDP comprising a plate which does not break when experiencing a first force, an air hole for passing air above and below the plate and in air communications with the tube, and a doughnut-shaped base disposed around the air hole and the tube, the protective device comprising:

a hollow shield with a first opening on a bottom end bonded to the doughnut-shaped base for containing the tube, the first opening of the hollow shield having a shape corresponding to a shape of the doughnut-shaped base; and a binding compound for binding the hollow shield onto the doughnut-shaped base, the hollow shield remaining bonded to the doughnut-shaped base when experiencing a second force which is smaller than the first force;

wherein when the hollow shield experiences an external force greater than the second force, the hollow shield will separate from the doughnut-shaped base without breaking the plate.

2. The protective device of claim 1, wherein the binding compound is silicone.

3. The protective device of claim 1, wherein the hollow shield comprises an arc-shaped outer shell for reducing an impact from the external force.

4. The protective device of claim 1, wherein the hollow shield is made of a transparent material.

5. The protective device of claim 1, wherein the hollow shield has a second opening on a top end.

6. The protective device of claim 1, wherein a safe distance between an inner wall of the hollow shield and the tube is greater than 2 cm to prevent compression of the tube by the hollow shield.

7. A protective device for a tube bonded on a plasma display panel (PDP), the PDP, comprising a plate which does not break when experiencing a first force, an air hole for passing air above and below the plate and in air communications with the tube, and a doughnut-shaped base disposed around the air hole and the tube, the protective device comprising:

a hollow shield with a first opening on a bottom end bonded to the plate and a second opening on a top end, the hollow shield surrounding the doughnut-shaped base for containing the tube; and a binding compound for binding the hollow shield onto the plate, the hollow shield remaining bonded to the plate when experiencing a second force which is smaller than the first force;

wherein when the hollow shield experiences an external force greater than the second force, the hollow shield will separate from the plate without breaking the plate.

8. The protective device of claim 7 wherein the binding compound is silicone.

9. The protective device of claim 7, wherein the hollow shield comprises an arc-shaped outer shell for reducing an impact from the external force.

10. The protective device of claim 7, wherein the hollow shield is made of a transparent material.

* * * * *